United States Patent [19]

Zbornik

[11] Patent Number: 4,842,473

[45] Date of Patent: Jun. 27, 1989

[54] MANIPULATOR FOR SHEET-METAL PIECES TO BE SHAPED IN A SHEET-METAL-WORKING MACHINE

[75] Inventor: Vaclav Zbornik, Oftringen, Switzerland

[73] Assignee: Hammerle AG, Zofingen, Switzerland

[21] Appl. No.: 56,603

[22] Filed: May 29, 1987

[30] Foreign Application Priority Data

May 30, 1986 [AT] Austria ..... 1462/86
Apr. 28, 1987 [AT] Austria ..... 1053/87

[51] Int. Cl.[4] ..... B66C 1/16

[52] U.S. Cl. ..... 414/626; 414/783; 414/785; 414/758; 414/627; 294/67.3; 294/902; 294/88; 294/67.31; 294/64.1; 294/81.2; 294/81.4

[58] Field of Search ..... 414/783, 626, 771, 758, 414/785, 627; 294/901, 902, 88, 81.2, 81.21, 81.4, 81.41, 81.51, 67.3, 67.31, 67.1, 64.1

[56] References Cited

U.S. PATENT DOCUMENTS 1,769,134 7/1930 Haff ..... 294/67.3
2,375,747 5/1945 Brown ..... 294/67.31
2,390,293 12/1945 Colson ..... 414/626 X
2,628,726 2/1953 Van Schie ..... 414/626 X
3,670,712 6/1972 Dunbar ..... 294/88 X
3,850,319 11/1974 Di Frank et al. ..... 414/771 X
4,238,169 12/1980 DePriester et al. ..... 414/626 X
4,465,314 8/1984 Parson et al. ..... 294/67.3 X
4,496,275 1/1985 Harp ..... 294/81.4 X
4,736,971 4/1988 McManus ..... 294/902 X

*Primary Examiner*—Frank E. Werner
*Attorney, Agent, or Firm*—Herbert Dubno

[57] ABSTRACT

The manipulator for sheet-metal pieces is used in conjunction with a sheet-metal working machine and has two rotatable holding members (20) displaceable in three dimensions. The holding members (20) each have both clamping tongs (22), which act on the surface of the sheet-metal piece (24) to be worked, and a clamping strip (23) exerting pressure parallel to the sheet surface. It thereby becomes possible for the sheet-metal piece to be worked, in a first working phase when it is still plane, to be grasped along two parallel edges by means of tongs and, after the first working, to be held only by means of the clamping strips.

4 Claims, 5 Drawing Sheets

MANIPULATOR FOR SHEET-METAL PIECES TO BE SHAPED IN A SHEET-METAL-WORKING MACHINE

FIELD OF THE INVENTION

The present invention relates to a manipulator for sheet-metal pieces to be shaped in a sheet-metal-working machine, with two rotatable holding members displaceble in three dimensions.

BACKGROUND OF THE INVENTION

The sheet-metal working machine can be, for example, a sheet-metal press, by means of which sheet-metal pieces are to be shaped.

There are already known sheet-metal-working machines, on which the shaping of metal sheets is carried out automatically and in preprogrammed manner by making the metal sheets pass automatically through the various operations required for the intended profiling. The manipulating devices used in conjunction with such sheet-metal-working machines are advantageous, particularly as regards the processing of large heavy metal sheets which a single worker, without an aid, can no longer move or can move only with difficulty. To grasp the sheet-metal pieces, there are usually two pairs of rotatable tongs which take hold of the metal sheets laterally, care being taken to ensure that the holding tongs are mounted so as to be displaceable in three dimensions.

In one known arrangement, a gripping device which grasps the sheet-metal piece on opposite sides by means of two pairs of tongs is used. However, for repeated use, there is a disadvantage in employing such tongs, because, when the tongs are used repeatedly, the highly sensitive surface of the sheet-metal piece is damaged, the tongs leaving impressions and other traces behind.

A further known arrangement which has suction cups as gripping members is also unsatisfactory. The use of suction cups has the disadvantage that the sheet-metal piece, particularly when it is thin, has a pronounced sag, so that it is possible to work efficiently only with a large number of suction cups which have to be distributed uniformly along the entire surface of the metal sheet. Since sheet-metal pieces of widely varying sizes are worked, it is not possible to obtain a practical design of a holding device with suction cups.

Finally, the use of clamping strips which are provided in pairs along two parallel edges of the sheet-metal piece. However, such clamping strips can only be used when the sheet-metal pieces have a certain rigidity and do not sag when gripped between the clamping strips.

OBJECT OF THE INVENTION

The object of the invention is to provide a manipulator which is of very simple design and which holds the sheet-metal pieces simply and securely, without damaging them.

SUMMARY OF THE INVENTION

This object is achieved with a manipulator for sheet-metal pieces to be shaped in a sheet-metal-working machine having two rotatable holding members displaceable in three dimensions, wherein the holding members have both clamping members acting in pairs along two parallel edges of the sheet-metal piece and holding devices acting on the surface of the sheet-metal piece, the clamping members exerting clamping pressure parallel to the sheet surface as a result of the adjustment of the distance between them while the holding devices act on the sheet-metal piece perpendicularly to the clamping direction.

The use of a holding member which has both clamping members and holding devices acting on the surface of the sheet-metal piece makes it possible for the sheet-metal piece to be worked, in a first working phase, to be grasped along two parallel edges by means of the tongs or by means of the clamping strips and suction cups and, after the first working, that is to say when the sheet-metal piece is no longer plane, but bent, to be grasped only by means of the clamping strips for the purpose of further working. This is now possible directly, since the rigidity of the sheet-metal piece can be increased substantially as a result of the initial shaping.

BRIEF DESCRIPTION OF THE DRAWING

Two embodiments of the manipulator according to the invention are illustrated in the accompanying drawing. In the drawing.

SPECIFIC DESCRIPTION

Figure 1:
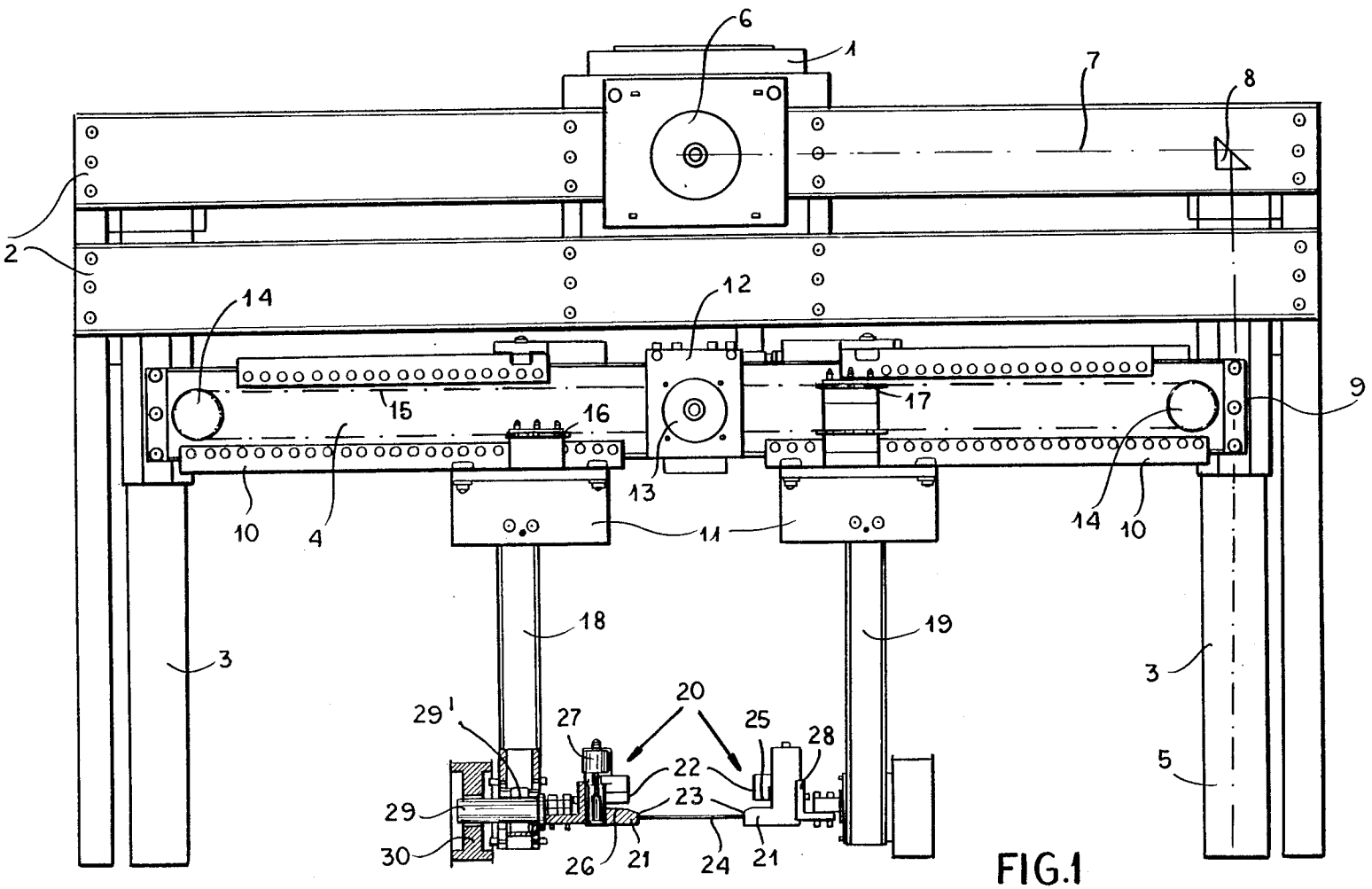
FIG. 1 shows a view of a first embodiment partially in vertical section.
Figure 2:
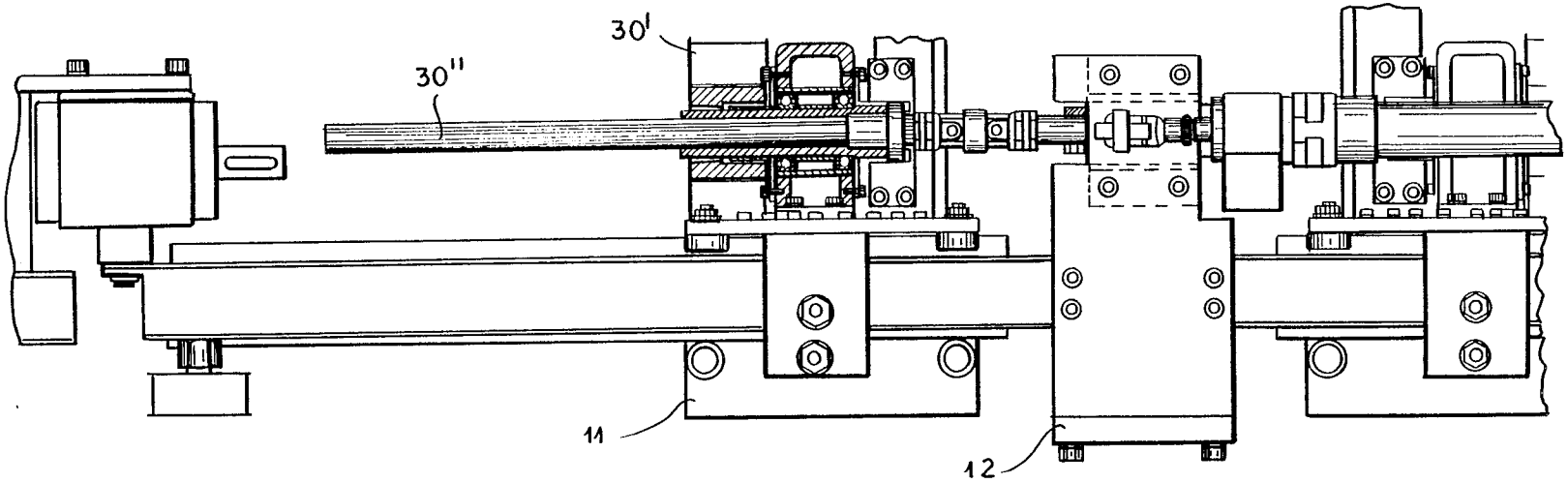
FIG. 2 shows a horizontal section and plan view in relation to FIG. 1.

The manipulator according to the first embodiment is equipped with a slide 1 which is arranged in front of a sheet-metal-working machine so as to be movable in two coordinate directions. On the slide 1 there is a double frame 2, to which are fastened two guide beams 3 extending vertically downwards. Between the two guide beams 3, a horizontal connecting beam 4 is arranged so that it can raised and lowered along the two guide beams 3. In each of the two guide beams 3, a spindle 5 is likewise directed vertically downwards, these spindles 5 being driven by a central drive motor 6 located in the double frame 2. The arrangement can be such that the motor 6 drives respective horizontal shafts 7 which each carry, at their ends facing the motor 6, a bevel-gear connection 8 which transmits the rotary movement of the respective shaft 7 to the spindle 5. Appropriate threaded nuts 9 engage with the spindle 8 so in that the movement of the spindle 5 causes the connecting beam 4 to be raised and lowered.

A rail 10 interrupted in the center is located on the connecting beam 4, and a respective carriage 11 is arranged displaceably on each of the two rail halves of rail 10 so as to hang down. To drive these carriages 11 along the rail halves, a drive motor 12 is arranged in the center of the connecting beam 4 and by means of a gear wheel 13 drives a chain 15 guided endlessly over deflecting rollers 14. One carriage 11 is connected to the lower chain strand and the other carriage 11 to the upper chain strand, so that, as a result of the to-and-fro movement of the chain 15, the carriages 11 approach one another or move away from one another. The connections between the chain 15 and the carriages 11 are designated by 16 and 17.

Each carriage 11 is provided with a vertical bearer 18, 19, these bearers each being equipped, at their lower ends, with a holding member 20 designed either as tongs or as a clamping strip for grasping a sheet-metal piece and arranged so as to be rotatable about a horizontal axis. Each holding member 20 is constructed with a lower jaw 21 and with a clamping jaw 22. Each lower jaw 21 has a clamping strip 23 lying in a vertical transverse plane, and the two clamping strips 23 of the lower jaws 21 are located directly opposite one another and can retain a sheet-metal piece 24 by exerting clamping pressure parallel to the sheet surface. This clamping pressure is generated by adjusting the distance between the two lower jaws 21.

The clamping jaw 22 has a clamping face 25 parallel to the sheet surface. Underneath the clamping face 25 is a corresponding clamping face 26 of the lower jaw 21, the above-mentioned clamping jaw 22 being movable up and down relative to the lower jaw 21, so that the two faces 25 and 26 form tongs which can be closed and opened. To actuate the tongs, there is an air cylinder 27 which closes the clamping jaw 22 held in the open position under the action of a spring.

The entire holding member 20 is arranged on an L-shaped support 28 which is itself connected firmly to a shaft 29. This is fastened rotatably to the lower end of the vertical bearer 18, 19 by means of bearings 29'. The end of the shaft 29 facing the support 28 carries a V-belt wheel 30 which is connected, by means of an endless belt (not shown), to a drive wheel 30' held on a splined shaft 30'' so as to be displaceable synchronously with the V-belt wheel 30. Thus, when the carriages 11 are shifted, the wheels 30, 30' execute the same movement. The drive wheel 30' shifts along on the splined shaft 30'' which at the same time serves for driving the wheel 30''.

The manipulator described operates as follows:

A plane sheet-metal piece to be worked, which is of a certain size, is clamped along two parallel edges between the two faces 25 and 26 by means of the tongs, because the air cylinder 27 presses the upper clamping jaw 22 against the lower jaw 21. After the sheet-metal piece has been received, it is delivered to the associated sheet-metal working machine not shown in the drawing, the movements necessary for this being executed by guiding the slides in two dimensions (the X and Y directions) and by adjusting the height of the connecting beam 4. After the first operation has been carried out, the sheet-metal piece is no longer plane, but has an appropriate shaping, as a result of which the rigidity of the sheet-metal piece has been increased substantially. The above-mentioned tongs are no longer required for further manipulation, but instead the sheet-metal piece is retained along two parallel edges between the two clamping strips 23 of the lower jaws 21. The further operations can be carried out subsequently.

In the way described, the highly sensitive surface of the sheet-metal piece is protected and not damaged by the tongs. No impressions are left by the tongs and there are no other traces.

Figure 3:
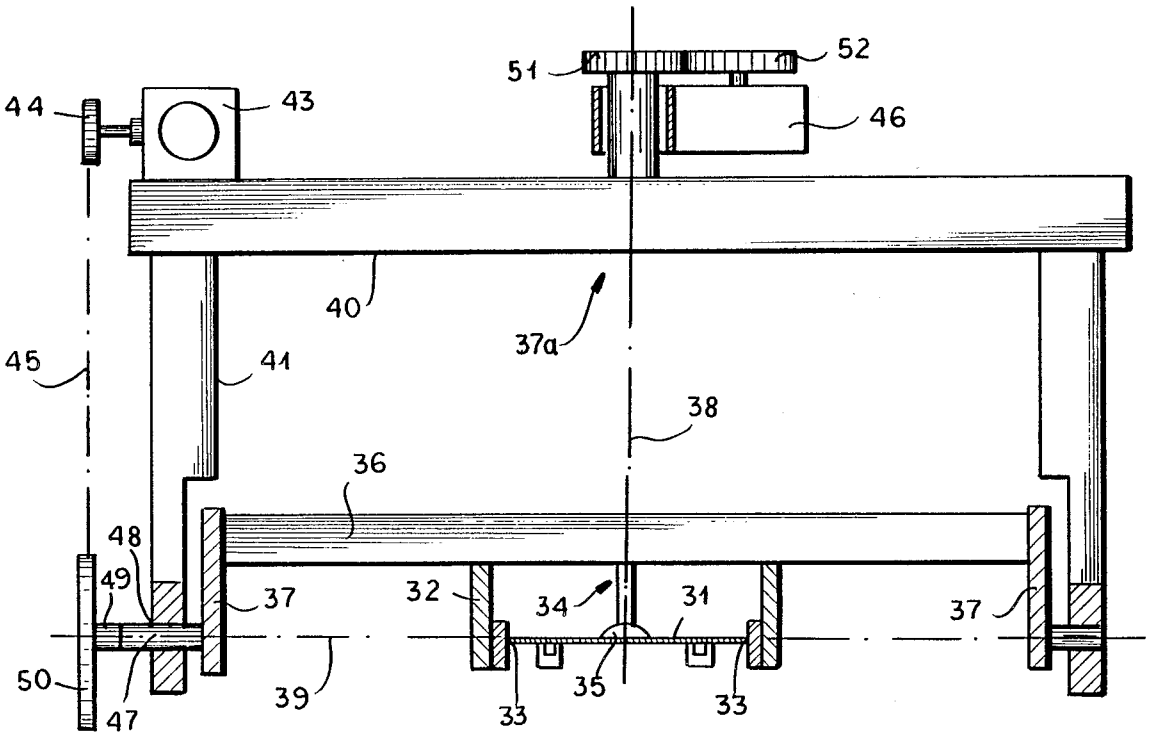
FIG. 3 shows a basic diagram of a second embodiment.

FIG. 3 shows the basic design and arrangement of the manipulator according to a further embodiment which, again, is used in conjunction with a sheet-metal working machine (not shown). The sheet-metal working machine is a conventional sheet-metal press with an exchangeable or adjustable die and with a ram which is movable relative to the die and by means of which the bending of a sheet-metal piece is carried out. To grasp the sheet-metal piece, which in FIG. 3 is shown diagrammatically and designated by 38, there are two gripping members 32 which grasp the sheet-metal piece on two parallel edges 33, so that the sheet-metal piece is clamped between the gripping members. At the same time, a holding device 34 is applied to the sheet surface and has suction cups 35 which retain the sheet-metal piece by means of a vacuum effect and which prevent the latter from sagging as a result of the gripping effect of the clamping members 32.

Both the clamping members 32 and the holding device 34 are arranged on a holding beam 36 which itself is accommodated, by means of two crank arms 37, in a U-shaped suspension device 37a so as to be rotatable about the horizontal axis 39. The axis of rotation 39 is in the plane of the sheet-metal piece, and the rotary movement can take place in both directions and amount to 180°. Furthermore, the beam 36, together with the suspension device 37a, is mounted so as to be rotatable about the vertical axis 38, once again through 180° in both directions. For rotation about the horizontal axis 39, there is a motor 43 which is fastened to the suspension device 37*a* and which, via a gear wheel 44 and a chain 45, drives a chain wheel 50 arranged in the axis 39. The crank arms 37 are fastened so as to be rotatable about the axis 39, and by means of these, the holding beam 36, together with the clamping members 32, the holding device 35 and the sheet-metal piece, can be pivoted. Rotation about the vertical axis 38 is effected by means of a motor 46 and a gear-wheel connection 51, 52 which causes the entire suspension device 37*a* to rotate.

Finally, the suspension device 37*a*, together with the holding beam 36 and rotary devices, is arranged so as to be displaceable in all three dimensions, the relevant means for this being known and not being explained in detail. Thus, there is adjustment of both height, depth and length.

The U-shaped suspension device 37*a* is composed of a horizontal box-shaped beam 40 and of two likewise box-shaped beams 41 which are arranged on the two ends of the beam 40 and which form the supporting frame both for the holding beam 36, together with the crank arms 37, clamping members 32 and holding device 34, and for the rotary devices which include the two motors 43, 46 and the associated chain transmissions 44, 45 and 51, 52.

Arranged on the projecting end of each of the crank arms 37 is a shaft butt 47 received in bearings 48 of the vertical beams 41. One shaft butt 47 has an extension 49 extending beyond the bearing 48 and carrying a chain wheel 50, the chain 45 being guided via said chain wheel 50 and via the gear wheel 44.

It has already been mentioned that the device as a whole is held so as to be adjustable in all three dimensions, and the constructive details relevant to this may be presumed to be known and are not shown in detail. For this purpose, there is appropriately provided a vertically adjustable slide which carries the suspension device 37a, together with the accessories, and the mounting of the slide can be adjusted in terms of both its length and its width. Such a design is described in detail, for example, in Austrian Pat. No. 378,701.

The holding beam 36 is arranged on the free end of the downward-extending vertical beam 41 so as to be rotatable about the horizontal axis. The arrangement is such that a rotation of 180° is possible in both directions, that is to say in the clockwise direction and the anti-clockwise direction. This rotation takes place about the shaft butts 47 by means of the gear wheel 50 which is itself connected to the gear wheel 44 of the servo-motor 43 via the chain 45.

The holding beam 36 is made box-shaped and on the inside has a guide rail 53 fastened in the holding beam 36 by means of webs 54. The clamping members 32 are fastened to this rail 53, in such a way that the distance between the two of them can be increased or reduced. The holding device 34 is also arranged on this beam 36, the detailed design of the said parts being explained with reference to FIG. 4.

Arranged displaceably on the rail 53 is a first slide 55 carrying a rod 56 extending vertically upwards and passing through a longitudinal slit 57 provided in the upper limitation of the holding beam 36. The upper free end of the rod 36 is connected, via a piston rod 58, to the piston 59 which can be subjected to pressure on both sides and which is accommodated in a cylinder 60. The cylinder 60 is fastened pivotably to the housing of the holding beam 36 at 61.

A second slide 62 is located at a distance from the slide 55. There is also a chain pull mechanism consisting of the chains 63 and 64 which are guided round deflecting rollers 65, 66 arranged at the two ends of the guide rail 53 and which connect the two slides 52 and 53 positively to one another. When the first slide 55 is shifted to the right in FIG. 4 by means of the piston 59 and the piston rod 58, at the same time the second slide 62 is shifted to the left by the same amount by means of the chain 64. When the first slide 55 shifts to the left, the second slide 62 is shifted to the right by means of the chain 63.

Each of the slides 55 and 62 is equipped with a holder 67 extending downwards, the lower limitation of the holding beam 36 being provided with corresponding longitudinal slits 68, through which the said holders 67 are guided. At the bottom of the holders 67 there are horizontal clamping member 69, by means of which the sheet-metal piece 70 to be worked is retained on two opposite parallel edges as a result of a clamping effect.

Since the clamping effect of the clamping members 69 is insufficient alone to hold the unbent sheet-metal piece 70 without deformation, there are one or more suction cups 35 which act as a holding device attainable to the sheet surface. The two suction cups 35 shown are fitted to a suction plate 71 which is designed as a hollow body and which is fastened centrally to the holding beam 36 by means of a suspension 72. The suspension 72 is hollow and communicates with a vacuum source via a line 73 shown merely diagrammatically. The suspension 72 is designed, for example, as a rigid tube which is freely movable in a guide 74 extending downwards, the lower end position of the tubular suspension 72 being limited by means of a stop ring 75. For retaining the tubular suspension 72, there is also a compressed-air brake which has a brake body 76 with brake jaws 77 surrounding the suspension and which is actuated by means of a cylinder 78. This is connected to a compressed-air source by means of a line 79 shown merely diagrammatically and is attached to a frame body 80 fastened to the outer face of the lower limitation of the holding beam 36. The frame body 80 partially surrounds the brake 76 and has a central recess for receiving the suspension 72 and the guide 74.

Figure 4:
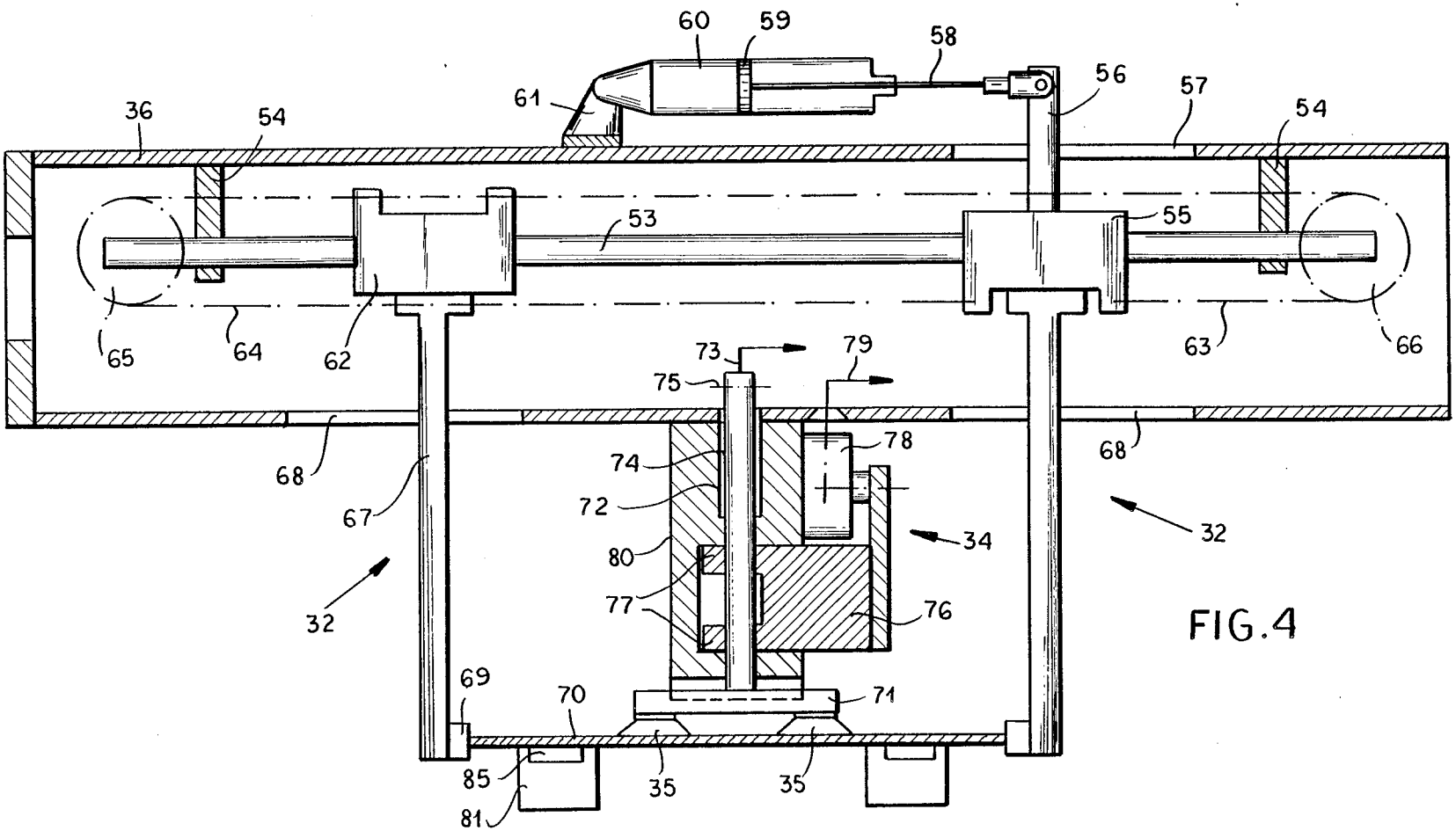
FIG. 4 shows a simplified representation of the parts important for the grasping action.
Figure 5:
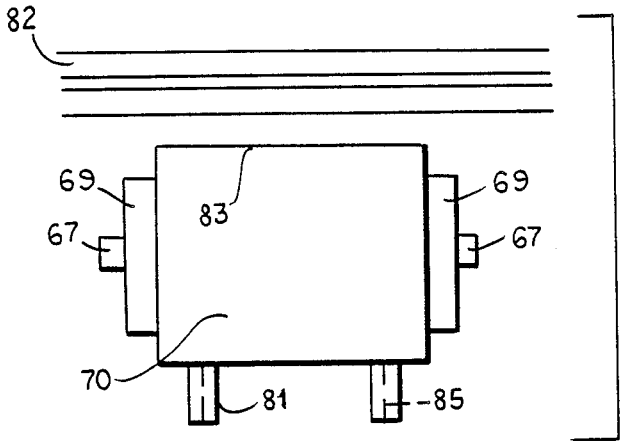
FIGS. 5 to 7 show basic diagrams of different uses of the manipulator according to the second embodiment.
Figure 6:
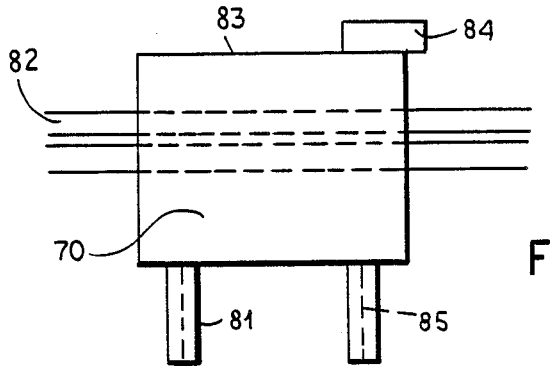
Figure 7:
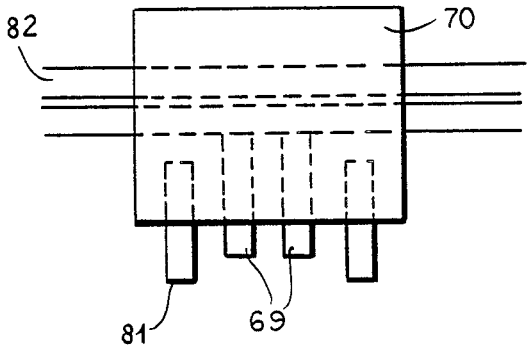

In the initial position, the sheet-metal piece 70 to be worked rests on supporting brackets 81. The manipulator is brought into use, so that the clamping members 69 engage two parallel edges of the sheet-metal piece 70 and the suction cups 35 rest on the sheet surface, the suspension 72 being pushed back somewhat, as shown in FIG. 4. This initial position of a sheet-metal piece 70 to be worked by means of an automatic bending device is represented in a plan view in FIG. 5. Working is carried out on the bending die 82 shown merely diagrammatically, the sheet-metal piece 70 first resting on the supporting brackets 81. The manipulator is brought into position, as is evident from FIG. 4, and the two parallel side edges of the sheet-metal piece 70 are gripped by means of the clamping members 69. For this purpose, the piston 59 is shifted from right to left (FIG. 4) and at the same time the freely suspended holding device 34 located above the sheet-metal piece is pushed back somewhat, suction cups 35 coming to rest on the surface of the sheet-metal piece 70. The holding device 34 is lowered simply by releasing the brake 76, so that the suspension 72, together with the suction plate 71 and suction cups 35, falls down under its own weight. In this position, the compressed-air brake 76 is actuated and the suspension 72 retained in the adopted position. A vacuum is applied through the line 73, so that the sheet-metal piece is supported in the center by the vacuum. It is not possible for the sheet-metal piece 70 to sag or bulge. Subsequently, the entire manipulator is moved in the direction of the bending device, so that the sheet-metal piece 70 is lifted off from the supporting elements 81, and that edge 83 of the sheet-metal piece 70 which faces the bending device and is parallel to the latter comes to rest on the other side of the die 82. The holders 67 are now moved away from one another and the clamping members 69 released. The suction cups 35 are also vented and removed from the sheet surface. In order to bring the sheet-metal piece into the prescribed bending position which, for example, is marked behind the bending device by a stop 84, conveyor belts 85 provided on the supporting brackets are first set in motion. After the sheet-metal piece has been removed completely from the conveyor belts, the clamping members 69 are moved toward one another, so that they assume the position evident from FIG. 6 and in this position act as pushing members for shifting the sheet-metal piece 70 further on the die 82 up to the stop 84. The sheet-metal piece 70 is now in the working position, and working is carried out by means of the ram. During the bending operation, the clamping members 69 now act as lifting aids and engage under the part of the sheet located in front of the bending die. They perform a supporting function during bending and can be used as stays.

The clamping members 69 described thus act not only as clamping members, but also as lower stays for the sheet and as pushing members to bring the sheet into the working position.

Subsequently, the clamping members 69 are brought up to the side edges of the sheet-metal piece 70 again, together with the suction cups 35, whereupon the sheet-metal piece 70 is brought into a position suitable for further working, for example as a result of the rotation and/or displacement of the manipulator.

It may also be mentioned, furthermore, that the supporting brackets 81 which, as mentioned, can be equipped with conveyor belts 85 are appropriately adjustable in terms of height and can also be adjusted in terms of the distance between them.

The last-described embodiment is especially suitable for light and narrow sheet-metal pieces which have to be bent several times and which cannot be grasped by means of tongs. By applying the holding device acting by means of a vacuum, it becomes quite possible to move the sheet-metal pieces grasped and clamped at the edges. Particularly careful treatment is achieved, since no impressions can be made on the sheet surface, these otherwise occurring frequently during the repeated use of tongs. Such impressions made by tongs not only have an unsightly effect, but also impair the precision of the finished product.

I claim:

1. A manipulator for the handling of sheet-metal sheets to be shaped in a sheet-metal-working machine, comprising:

a mobile support;

two arms mounted on said support so that ends of said arms can be approached to and displaced away from one another;

means forming respective clamping members on said ends of said arms engageable with opposite edges of a sheet-metal workpiece received between said members and displaceable in a direction parallel to a plane of said sheet-metal workpiece whereby said clamping members exert a clamping pressure on said workpiece in said plane, said arms being provided with means enabling rotation of said clamping members about an axis; and holding means actuatable independently of the displacement of said clamping members and acting upon said sheet-metal workpiece in a direction perpendicular to said plane for seizing said workpiece until shaping of said workpiece renders the workpiece sufficiently stiff to be supported exclusively by said clamping pressure, said holding means being formed as a respective clamping tongs on each end of said arm and said clamping members being clamping strips, said support comprising a supporting structure fastened to a slide movable in two coordinate directions and carrying a horizontal beam adjustable in the vertical direction, said beam being provided with said arms which are adjustable in terms of the distance between them, said arms being provided with holders each carrying a respective one of said tongs and a respective clamping member and being arranged to be rotated by a horizontal shaft, the free ends of said arms being each provided with a holding member having both a clamping tongs and a clamping strip are each fastened rotatably to a lower end of the respective arm and said arms are vertical and each holding member having a lower jaw with a horizontal clamping face and a vertical clamping strip, and a clamping jaw which is movable relative to the lower jaw and which has a clamping face located opposite the clamping face of the lower jaw.

2. The manipulator as defined in claim 1 wherein the supporting structure is a double frame equipped with two guide beams which extend vertically downwardly and between which said horizontal beam is guided so as to be vertically adjustable.

3. The manipulator as defined in claim 2, further comprising carriages displaceable on rails by means of a chain pull mechanism disposed in the guide beam to execute movements in opposite directions to one another, said arms being mounted respectively on said carriages.

4. The manipulator as defined in claim 1 wherein the shaft is driven by a V-belt connection, the drive wheel of which is held on a splined shaft so as to be displaceable synchronously with the movement of the carriages.

* * * * *